United States Patent [19]

Hodgkins et al.

[11] 4,452,039

[45] Jun. 5, 1984

[54] EXPENDABLE INFRARED SOURCE AND METHOD THEREFOR

[75] Inventors: Harry L. Hodgkins, Upper Marlboro; John K. Reingruber, Waldorf, both of Md.; Kenneth E. Harwell, Tullahoma, Tenn.

[73] Assignee: The United States of America as represented by the Secretary of the Navy, Washington, D.C.

[21] Appl. No.: 511,351

[22] Filed: Jul. 6, 1983

[51] Int. Cl.[3] ..... C06D 5/00

[52] U.S. Cl. ..... 60/207; 60/253; 102/336; 102/505

[58] Field of Search ..... 89/1 A; 102/336, 505; 60/207, 219, 253, 254

[56] References Cited

U.S. PATENT DOCUMENTS 3,423,942 1/1969 Spindler ..... 60/207

3,486,339 12/1969 Owens et al. ..... 60/261

3,946,555 3/1976 Goede ..... 60/219

4,222,306 9/1980 Maury ..... 102/505

*Primary Examiner*—Leland A. Sebastian

*Attorney, Agent, or Firm*—Robert F. Beers; Arthur L. Branning; Thomas E. McDonnell

[57] ABSTRACT

An IR source and method for generating IR radiation whereby a propellant is burned in a first chamber to produce a product gas which is exited through a critical exit, is accelerated to a supersonic velocity by expanding into a second chamber, is passed through a standing shock wave in the chamber to reduce the gas velocity to a subsonic level, is exited through radial orifices into a larger third chamber where the gas is mixed to obtain a substantial uniformity in temperature and specie, is accelerated by expansion to a chosen subsonic velocity, and is exhausted to the atmosphere.

16 Claims, 2 Drawing Figures

EXPENDABLE INFRARED SOURCE AND METHOD THEREFOR

BACKGROUND OF THE INVENTION

The present invention pertains generally to targets and in particular to a source of IR radiation for targets.

Expendable sources of infrared radiation are required for purposes such as target practicing and testing. The IR radiation, in about all circumstances, must meet precise requirements as to wave length and intensity of radiation and to the spacial distribution of the radiation. If the IR source is attached to a tow target, severe restrictions on the thrust level must also be met.

There are four types of expendable IR sources and each has serious limitations. Flares have been used as expendable IR sources. They are pyrotechnic devices which burn at atmospheric pressure and produce a high-intensity, point source of radiation. These devices are generally adequate at tail-on aspect angles, but do not adequately simulate the scale factors of rocket or turbojet exhaust plumes at side-on aspect angles.

Infrared radiation has also been obtained from seeding torch flames or the exhaust of gas generators, either solid or liquid fueled. The advantages of this type are high source levels with little propulsive thrust and less of a point-source character than flares have. The disadvantages are the black-body nature of the radiation, smokiness and inadequate scale factors at side-on aspect angles. An example of this type of IR source is found in U.S. Pat. No. 3,946,555, issued on Mar. 30, 1976 to Philip J. Goede in which inorganic materials, capable of emitting after ejection a continuum infrared radiation in the wave length range of about 1 to 14 microns, are dispersed in a composite propellant.

The exhaust from conventional rocket propellants after expanding through typical converging-diverging supersonic nozzles does produce IR emissions. Unfortunately, to achieve the required plume length and IR-source strength, unacceptably high thrust levels are produced which would disturb the aerodynamics of the tow target. Also, the required mass-flow rate and desired duration may be inconsistent with the payload capability of the tow target. Encouraging afterburning to increase IR output would reduce mass-flow-rate requirements and thrust level, but afterburning in itself is an undesirable characteristic for many applications because it alters the spacial distribution of radiation in the plume, which is important for side-on aspect angles.

Another expendable infrared radiation source is a turbojet powered target drone which has carbon particles injected into its exhaust plume to augment IR output. The disadvantages are black-body spectra as opposed to line spectra of the emitted radiation and the smokiness of the exhaust. Also, this source of infrared radiation is not applicable to tow targets which are preferred over jet-powered target drones because of their reduced costs.

SUMMARY OF THE INVENTION

It is, therefore, an object of this invention to provide an expendable and inexpensive IR radiation source which has, for each given gas-generation rate, a minimal reactive thrust and a maximum plume length and integrity.

Another object of the present invention is to produce IR radiation with a predictable IR intensity, i.e., afterburning with the surrounding air is minimized.

A further object of the present invention is to provide line-spectra IR radiation as opposed to black-body radiation, i.e., IR emissions from gaseous products of combustion as opposed to emissions from solid particulate matter in the exhaust stream.

These and other objects are achieved by combusting a propellant in a chamber to produce a hot, high-pressure product gas, exiting the product gas through a critical exit so that the combustion process is controlled by rocket design principles, shocking down the product gas to a subsonic velocity which reduces the stagnation pressure and thus the capability of the product to propel, restoring uniform flow conditions, accelerating the product gas, and exiting the gas to the atmosphere.

DETAILED DESCRIPTION OF THE INVENTION

Figure 1:
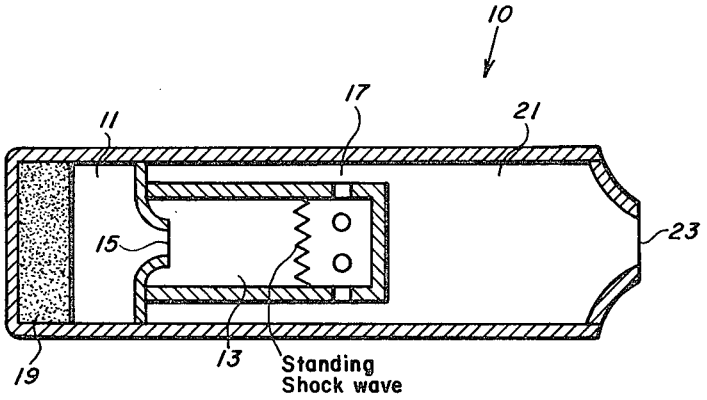
FIG. 1 is a cross-sectional view of an infrared source of the present invention.

Referring to FIG. 1, IR source 10 is shown to comprise a combustion chamber 11 containing an energetic composition 19 and having a critical exit 15, a shock chamber 13 fixedly connected to and in communication with the combustion chamber 11 through the critical exit 15, and a plenum chamber 21 fixedly connected to and in communication with the shock chamber 13 through diffuser orifices 17. The plenum chamber 21 exhausts to the atmosphere through exhaust means 23.

The shock chamber 13 is centrally located in the plenum chamber 21. The end opposite to exit 15 is preferably blunt because of simplicity of construction and near that end is a plurality of radial orifices 17. The L/D for the chamber is preferably 1:1 to 5:1 and preferably 2:1 to 5:1. The number and size of the orifices are selected to maintain a standing shock wave and exhaust the product gases subsonically, preferably at Mach 0.1 to 0.5.

The location of the shock wave is between the combustion chamber exit 15 and the plane of the most upstream radial orifices 17. Since the purpose of the shock is to reduce the energy and pressure of the product gas and to increase the temperature of the product gas, the preferred position of the shock wave is at or near the point of maximum velocity.

Infrared source 10 operates through the burning of an energetic composition 19 which produces mostly gases with few solid products in the combustion chamber 11. The product gas enters the shock chamber 13 through a critical exit 15 which is preferably convergently contoured, e.g., a nozzle. A critical exit is one in which the velocity of a fluid passing through has a Mach number of 1.

Upon entering the shock chamber the product gas expands, increasing the gas velocity to supersonic levels. The product gases pass down the chamber to a standing shock wave created by the restricted outlet, i.e., the diffuser orifices 17. The shock chamber, thus, acts as a supersonic diffuser. Passage of the product through the standing shock wave is a nonisentropic process which results in a large entropy gain, a large loss in stagnation pressure and a conservation of stagnation temperature. The static temperature and pressure are increased by the decrease in velocity to close to their maximum values, i.e., the value at zero velocity. Since the entropy gain is proportional to the amount of decrease in the gas velocity, it is preferred that the velocity of the product gas reaches at least Mach 2 and most preferably at least Mach 3 before passing through the standing shock wave. The net result of the shocking/diffusing process is the establishment of high-temperature/low-pressure conditions in the plenum chamber 21. The high temperature provides the proper IR radiation and the low pressure insures little or no propulsion.

The terms: static temperature and pressure and stagnation temperature and pressure are used in their accepted meanings. Stagnation pressure and temperature are measured at zero velocity. They represent the maximum temperature and pressure of a fluid stream. Static pressure and temperature are measured near the boundary layer of a fluid stream and represent the temperature and pressure of a stream in which a portion of the energy of the system is in the velocity of the stream.

Upon exiting the shock chamber, the product gas passes through a plenum chamber 21. This chamber serves as a mixing chamber where the product gas is mixed to obtain a uniform temperature and specie distribution before being exhausted to the atmosphere through exhaust 23. The free volume of the plenum chamber 21 is sufficient to insure an adequate residence time (0.1 to 4 msec) to achieve adequate mixing. The L/D of the plenum chamber is from 2:1 to 5:1 and preferably 2.5:1 to 4:1. Plenum chambers larger than these dimensions would be effective, but they would not provide any benefit for the increased cost, would become too large for many target applications and would suffer substantial energy losses to the walls.

An additional purpose of exhaust 23 is to give a final adjustment to the velocity of the product gases, either increasing or decreasing the velocity in order to closely match the target speed. If the velocity of the product gas exhausting to the atmosphere is greater than the target, then thrust to the target would exist, thereby decreasing the stability of the target. Also the integrity of the exhaust plume would be too quickly destroyed by the shear forces between the relatively stationary atmosphere and the fast flowing exhaust. If the velocity of the exhausting gases is less than the target, the destruction of the plume integrity would also be hastened by the shear forces generated. Consequently exhaust 23 is preferably sized to exhaust the product gases at about the velocity of the target. The preferred configuration of exhaust 23 is one or more nozzles. The single nozzle would produce a longer and narrower plume than would a multiple nozzle exhaust. The nozzle shape is preferred because of its relatively simple construction and the relatively low energy losses through the nozzle.

Figure 2:
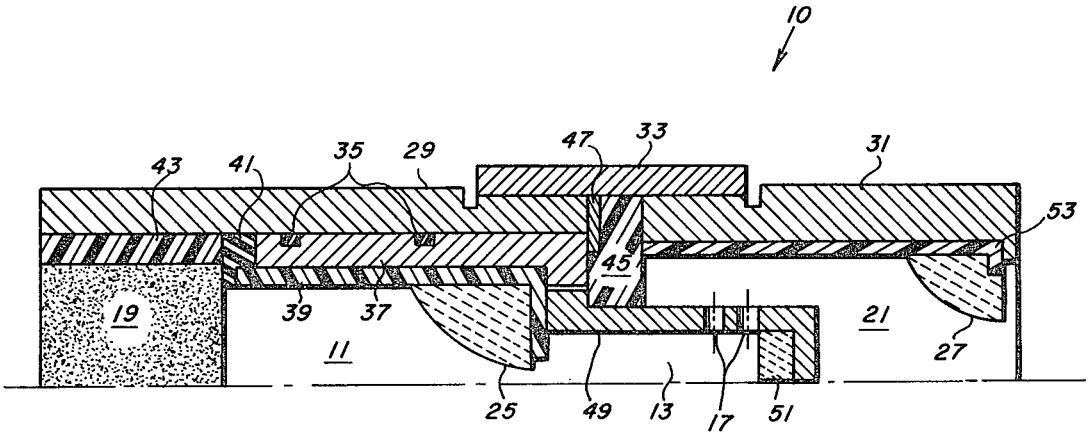
FIG. 2 is a cross-sectional view of a detailed half section of a preferred infrared source of the present invention.

FIG. 2 shows a cross section of the IR source 10 in detail that was used in the following examples. The outer shell of IR source 10 is manufactured in two metal sections 29 and 31 which are joined by a union 33. The combustion chamber 11 is placed inside shell 29 and the O-rings 35 establish a seal between the two. The combustion chamber 11 comprises a nozzle 25, a shell 37, an insulator 39 and a spacer 41. A propellant 19 with an inhibitor liner 43 is placed inside the combustion chamber. Between the two sections 29 and 31, an insulating shim 45 and a back-up ring 47 are placed. The shock chamber 13 comprises a shell 49, diffuser orifices 17 and an anti-erosion disc 51. The plenum chamber 21, defined by shell 31, has an insulator 53 and an exhaust nozzle 27.

The shell 37 defining the combustion chamber 11 is fabricated from a reasonably high-strength material, such as steel. The surface of shell 37 is protected from the heat and corrosive effects of the reaction by the insulator 39 made from a suitable material, e.g., phenolic or polyepoxy plastic. At the exhaust port a converging nozzle 25 is fabricated from an inert, high-temperature material, such as graphite. It is sized to produce critical flow into the shock chamber 13. Between the propellant 19 and the shell 37 along with the insulator 39 is a spacer 41 made from silicon rubber or a similar inert resilient material. An insulating shim 45 made from phenolic or another suitable material is placed between sections 29 and 31 in order to reduce heat transfer from the combustion chamber 11. To give added strength to the insulating shim 45, a steel or similar material back-up ring 47 is added to the shim.

The shell 49 of the shock chamber is fabricated from molybdenum or another high-temperature material. The closed end of the shock chamber 13 is protected by an anti-erosion disc 51 made preferably from graphite. A plurality of orifices 17 is placed radially in shell 49 as diffuser orifices 17. Orifices 17 open into a larger chamber referred to as a plenum chamber 21. The shell 31 which defines the plenum chamber 21 is protected by an insulating layer 53 which can be made from a high temperature material such as a phenolic or polyepoxy plastic. The gases in the plenum chamber 21 exit through nozzle 27 which is preferably made from graphite.

In order to demonstrate the effectiveness of the present invention the following examples are given. It is understood that these examples are given by way of illustration and are not intended to limit this disclosure or the claims to follow in any manner.

EXAMPLE I

The IR source of this invention which was tested was 50 cm. in overall length and 15 cm. in diameter. The shock chamber had a length of 15 cm., an inner diameter of five cm., a sonic (critical) inlet nozzle with a cross-sectional area of 0.13 sq. cm., and eight diffuser orifices with a total cross-sectional area of one sq. cm. The plenum chamber had an inner diameter of nine cm., a length of twenty cm. and an exit nozzle with an inner diameter of five cm. at the exit.

The propellant used in the experiment was the standard AHH cast double-base propellant, which comprise 40 weight percent nitroglycerin, 40 weight percent nitrocellulose, and 20 weight percent of other ingredients. The AHH designation is the one given by the Chemical Propulsion Information Agency (CPIA) in their specifications and standards for approved propellants. The propellant was inhibited by cellulose acetate and asbestos phenolic was used for motor insulation. The propellant generated a product gas at a rate of 0.21 kg-sec at 50 atm. and had a flame temperature of about 2300° C. and a $C_p/C_v$ of 1.24. About 400 gm was used in the firing.

The product gas, after exiting the sonic inlet nozzle, expanded to the 5-cm. diameter shock-chamber wall and reached a Mach number of about 4.4 with a static temperature drop of about 500° C. A strong normal shock was established in the flow passage of the shock chamber. At steady-state operation the normal shock stood off the end plate of the shock chamber far enough to have allowed a 0.21 kg/sec gas-flow rate to exit the shock chamber radially through the diffuser orifices. At steady state operation, the product gas, after the shock wave, had a Mach number of 0.4, a static pressure of about two atmospheres and a static temperature of about 2100° C.

Shock chamber and plenum chamber conditions were calculated, as were exhaust plume length and IR intensity. Performance of the IR source was then determined by comparing the observed plume length and intensity (4–6 foot length, 400 watts/steradian @ 4→5 microns) with calculated values. Exhaust plume characteristics were grossly different from what this propellant and gas generation rate would produce if the product gases were exhausted through a standard convergent/divergent supersonic rocket nozzle. Observations were made with IR radiometers (for intensity) and Thermo-Vision for IR plume length. Observed values agreed closely with calculated IR source performance.

EXAMPLE II

The exit conditions of the exhaust gases of the previous example were compared to a rocket firing the same propellant. Table I summarizes the results.

TABLE I

| | Units | I.R. | Rocket |
|---|---|---|---|
| Static Temp. | °C. | 2253 | 1122 |
| Static Press | atm | 1.8 | 1.8 |
| Stagnation Temp | °C. | 2329 | 2329 |
| Stagnation Press | atm | 2.1 | 47.6 |
| Mach No. | — | 0.5 | 2.7 |
| Thrust | kg | 5.6 | 13 |
| Plume Length | m | 1.8 | 0.14 |
| Velocity | m/sec | 519 | 2827 |

The results from Examples I and II confirm that passing through a normal standing shock wave is a non-isentropic process which results in a large entropy gain and a large loss in stagnation pressure. Stagnation temperature is not lost, however, and the net result of the shocking/diffusing process is the establishment of high-temperature/low-pressure conditions in the plenum chamber. Accelerating the product gas through the exhaust nozzle results in a high-thermal energy, low-kinetic-energy exhaust stream which delivers a much lower propulsive force (less than one half) than that of a normal rocket of the same mass-flow rate and exit static pressure. The high exit temperature (more than double) and slow mixing rates of the shock-free exhaust plume result in a longer (nearly 13×) more intense infrared plume than that which is produced by a normal rocket at the same mass-flow rate.

Many obvious modifications and embodiments of the specific invention, other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the United States is:

1. An infrared-radiation source for simulating the plume produced by a reactive engine which comprises:
   - a combustion chamber wherein an energetic composition is reacted to produce a hot, high-pressure product gas, said chamber having a critical exit, thereby enabling the combustion process to be controlled by the rocket motor design;
   - a supersonic diffuser means in communication through said critical exit with said combustion chamber, whereby the velocity of said product gas is reduced to a subsonic level;
   - a plenum chamber in communication with said supersonic diffuser means wherein the gas-flow streams of said product gas exiting from said supersonic diffuser means are mixed, said plenum chamber having an exhaust means for exhausting said product gas to the atmosphere.

2. The infrared-radiation source of claim 1 wherein said supersonic diffuser means comprises a substantially cylindrical chamber having a plurality of radial orifices near the end opposite to said critical exit, said orifices being sized for evacuating said product gas and producing a standing shock wave in said chamber.

3. The infrared-radiation source of claim 2 wherein said orifices are sized to produce a standing shock wave in said chamber at or near the point of maximum velocity.

4. The infrared-radiation source of claim 2 wherein the L/D ratio of said chamber is from 2:1 to 5:1.

5. The infrared-radiation source of claim 3 wherein the L/D ratio of said chamber is from 2:1 to 5:1.

6. The infrared-radiation source of claim 2 wherein said plenum chamber is sized so that the transit time of said product gas is from about 0.1 msec to about 4 msec.

7. The infrared-radiation source of claim 5 wherein said plenum chamber is sized so that the transit time of said product gas is from about 0.1 msec to about msec.

8. The infrared-radiation source of claim 6 wherein said exhaust means is sized so that said product gas is exhausted from the plenum chamber at a subsonic velocity, thereby producing a shock-free plume of predictable IR intensity.

9. The infrared-radiation source of claim 7 wherein said exhaust means is sized so that said product gas is exhausted from the plenum chamber at a subsonic volocity, thereby producing a shock-free plume of predictable IR intensity.

10. The infrared-radiation source of claim 8 wherein said exhaust means is sized so that said product gas is exhausted at a velocity approximately equal to that of said infrared-radiation source in motion.

11. The infrared-radiation source of claim 9 wherein said exhaust means is sized so that said product gas is exhausted at a velocity approximately equal to that of said infrared-radiation source in motion.

12. A process for generating IR radiation to simulate the plume produced by a reactive engine which comprises: combusting an energetic composition in an enclosure to produce a product gas; exiting said product gas from said enclosure at Mach 1; accelerating said product gas to a supersonic velocity; passing said product gas through a standing shock wave to reduce the velocity of said product gas to a subsonic velocity and to reduce the stagnation pressure of said product gas, mixing said product gas to obtain a substantially uniform temperature and specie distribution, and exhausting said product gas to the atmosphere.

13. The process of claim 12 wherein the supersonic velocity of said product gas is at Mach 2.

14. The process of claim 12 wherein the supersonic velocity of said product gas is at least Mach 3.

15. The process of claim 14 wherein said gas is exhausted to the atmosphere at a subsonic velocity.

16. The process of claim 14 wherein said gas is exhausted to the atmosphere at approximately the same velocity as that of said infrared-radiation device in motion.

* * * * *